US009589499B2

(12) United States Patent
Park

(10) Patent No.: US 9,589,499 B2
(45) Date of Patent: Mar. 7, 2017

(54) DISPLAY DEVICE HAVING FUNCTION OF CONTROLLING LUMINANCE BASED ON AVERAGE PICTURE LEVEL AND LUMINANCE CONTROL METHOD THEREOF

(71) Applicant: LG ELECTRONICS INC., Seoul (KR)

(72) Inventor: Sungjin Park, Pyeongtaek-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/143,643

(22) Filed: Dec. 30, 2013

(65) Prior Publication Data

US 2015/0062187 A1 Mar. 5, 2015

(30) Foreign Application Priority Data

Sep. 2, 2013 (KR) ..... 10-2013-0105124

(51) Int. Cl.
*G09G 3/30* (2006.01)
*G09G 3/32* (2016.01)
*G09G 3/34* (2006.01)

(52) U.S. Cl.
CPC ..... *G09G 3/3225* (2013.01); *G09G 3/3413* (2013.01); *G09G 2320/04* (2013.01); (Continued)

(58) Field of Classification Search
CPC ..... G09G 3/14; G09G 3/28–3/288; G09G 3/30–3/3291; G09G 2310/0216; G09G 2320/0233
See application file for complete search history.

(56) References Cited

U.S. PATENT DOCUMENTS 6,924,825 B1 * 8/2005 Bannai ..... 345/690
2003/0164810 A1 * 9/2003 Kim ..... 345/63
(Continued)

FOREIGN PATENT DOCUMENTS

CN 101151653 3/2008
CN 102024423 4/2011
(Continued)

OTHER PUBLICATIONS

European Search Report dated Mar. 14, 2014 issued in Application No. 14 15 0261.7.
(Continued)

*Primary Examiner* — Sanghyuk Park
(74) *Attorney, Agent, or Firm* — KED & Associates LLP

(57) ABSTRACT

A display device and a method for controlling a luminance of the display device are disclosed. The display device includes an average picture level (APL) calculator which calculates an APL of an input image and outputs the APL of the input image and an APL curve data, a luminance adjuster which includes at least two luminance adjusting units enabled in response to a user input through a user interface and reduces a luminance of an APL section equal to or less than a predetermined reference value, a data modulator modulating data of the input image using a luminance defined in the APL curve data, and a display panel driving circuit which writes data from the data modulator on a display panel and reproduces the input image on the display panel.

14 Claims, 10 Drawing Sheets

(52) U.S. Cl.
CPC ..... *G09G 2320/0606* (2013.01); *G09G 2320/103* (2013.01); *G09G 2320/106* (2013.01); *G09G 2330/021* (2013.01); *G09G 2360/144* (2013.01); *G09G 2360/16* (2013.01)

(56) References Cited

U.S. PATENT DOCUMENTS

| | | | | |
|---|---|---|---|---|
| 2006/0221260 | A1 | 10/2006 | Fujine et al. | 348/790 |
| 2007/0222738 | A1* | 9/2007 | Yoshida | 345/101 |
| 2008/0037866 | A1* | 2/2008 | Na | 382/168 |
| 2008/0068312 | A1 | 3/2008 | Kim | 345/84 |
| 2008/0284702 | A1* | 11/2008 | Shidara et al. | 345/90 |
| 2008/0297467 | A1* | 12/2008 | Hsu et al. | 345/102 |
| 2010/0171770 | A1* | 7/2010 | Inoue et al. | 345/690 |
| 2011/0069098 | A1* | 3/2011 | Lee et al. | 345/691 |
| 2011/0205442 | A1 | 8/2011 | Mori et al. | |
| 2011/0227966 | A1 | 9/2011 | Mori | 345/690 |
| 2011/0317074 | A1* | 12/2011 | Kim et al. | 348/673 |
| 2012/0306872 | A1* | 12/2012 | Owaki et al. | 345/419 |
| 2012/0306947 | A1* | 12/2012 | Kim et al. | 345/694 |

FOREIGN PATENT DOCUMENTS

| | | |
|---|---|---|
| CN | 102292757 | 12/2011 |
| CN | 102298894 | 12/2011 |

OTHER PUBLICATIONS

European Search Report dated Sep. 11, 2015 issued in Application No. 14 150 261.7.

Chinese Office Action for application 201410025522.7 dated Jun. 3, 2016 (English translation & Chinese full text).

* cited by examiner

| | |
|---|---|
| Vivid | Off |
| Standard | Low |
| Cinema | Off |
| Game | Off |

DISPLAY DEVICE HAVING FUNCTION OF CONTROLLING LUMINANCE BASED ON AVERAGE PICTURE LEVEL AND LUMINANCE CONTROL METHOD THEREOF

This application claims the benefit of Korean Patent Application No. 10-2013-0105124 filed on Sep. 2, 2013, the entire contents of which is incorporated herein by reference for all purposes as if fully set forth herein.

BACKGROUND OF THE INVENTION

Field of the Invention

Embodiments of the invention relate to a display device and a method for controlling a luminance of the display device.

Discussion of the Related Art

Examples of a flat panel display include a liquid crystal display (LCD), a plasma display panel (PDP), an organic light emitting display, and an electrophoresis display (EPD). The liquid crystal display displays an image by controlling an electric field applied to liquid crystal molecules based on a data voltage. An active matrix liquid crystal display has advantages of a reduction in the production cost and an improvement of a performance with the development of the process technology and the driving technology. Thus, the active matrix liquid crystal display is the most widely used display device applied to almost all display devices including small mobile equipments and large-sized televisions.

Because the organic light emitting display is a self-emitting device, it has advantages of lower power consumption and thinner profile than the liquid crystal display requiring a backlight unit. Further, the organic light emitting display has advantages of a wide viewing angle and a fast response time. Thus, the organic light emitting display has expanded its market while competing with the liquid crystal display.

Each pixel of the organic light emitting display includes an organic light emitting diode (OLED) having a self-emitting structure. As shown in FIG. 1, the OLED includes organic compound layers, such as a hole injection layer HIL, a hole transport layer HTL, an emission layer EML, an electron transport layer ETL, and an electron injection layer EIL, which are stacked between an anode and a cathode. The organic light emitting display reproduces an input image using a phenomenon in which the OLED emits light when electrons and holes are combined in an organic layer of the OLED through a current flowing in a fluorescence or phosphorescence organic thin film.

The organic light emitting display may be variously classified depending on a light emitting material, a light emitting manner, a light emitting structure, a driving method, etc. The organic light emitting display may be classified into a fluorescence emission type and a phosphorescence emission type depending on the light emitting manner, and may be classified into a top emission type and a bottom top emission type depending on the light emitting structure. Further, the organic light emitting display may be classified into a passive matrix OLED (PMOLED) type and an active matrix OLED (AMOLED) type depending on the driving method.

It is necessary to reduce a luminance of a screen greatly affecting the power consumption so as to efficiently reduce the power consumption of the display device. The power consumption may be reduced through a simple method for reducing the luminance of the screen, but the image quality may be degraded.

SUMMARY OF THE INVENTION

Embodiments of the invention provide a display device and a method for controlling a luminance of the display device capable of minimizing a reduction in image quality and reducing power consumption.

In one aspect, there is a display device comprising an average picture level (APL) calculator configured to calculate an APL of an input image and output the APL of the input image and an APL curve data, a luminance adjuster including at least two luminance adjusting units, which are enabled in response to a user input through a user interface, the luminance adjuster reducing a luminance of an APL section, which is equal to or less than a predetermined reference value, in the APL curve data, a data modulator configured to modulate data of the input image using a luminance defined in the APL curve data adjusted by the luminance adjuster, and a display panel driving circuit configured to write data from the data modulator on a display panel and reproduce the input image on the display panel.

In another aspect, there is a method for controlling a luminance of a display device comprising calculating an average picture level (APL) of an input image and outputting the APL of the input image and an APL curve data, reducing a luminance of an APL section, which is equal to or less than a predetermined reference value, in the APL curve data in response to a user input through a user interface, modulating data of the input image based on a luminance defined by the APL curve data, in which the luminance of the APL section is adjusted, and writing the modulated data on a display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

In the following description, exemplary embodiments of the invention will be described using an organic light emitting display as an example of a flat panel display. Other types of flat panel displays may be used.

Figure 2:
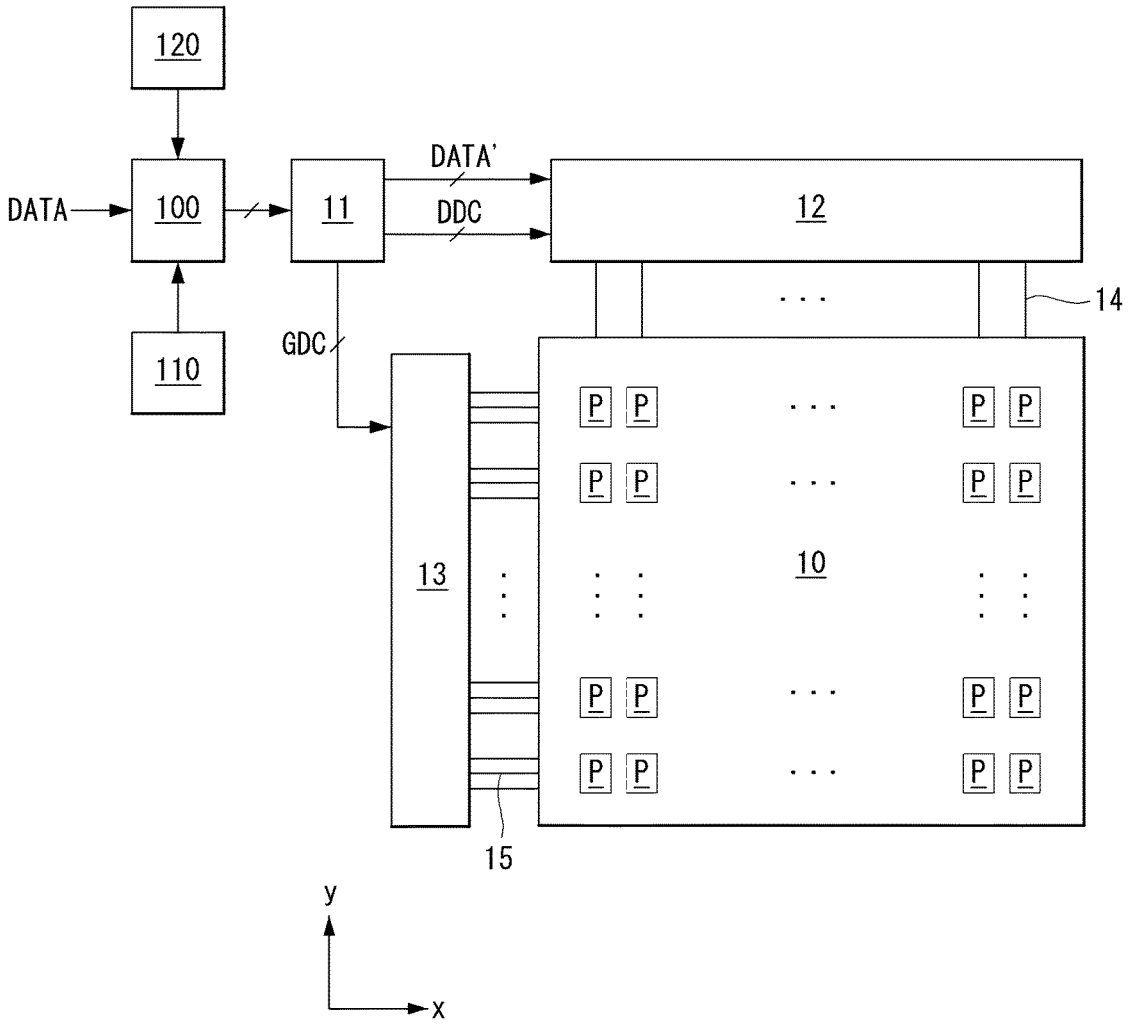
FIG. 2 is a block diagram of an organic light emitting display according to an exemplary embodiment of the invention.
Figure 3:
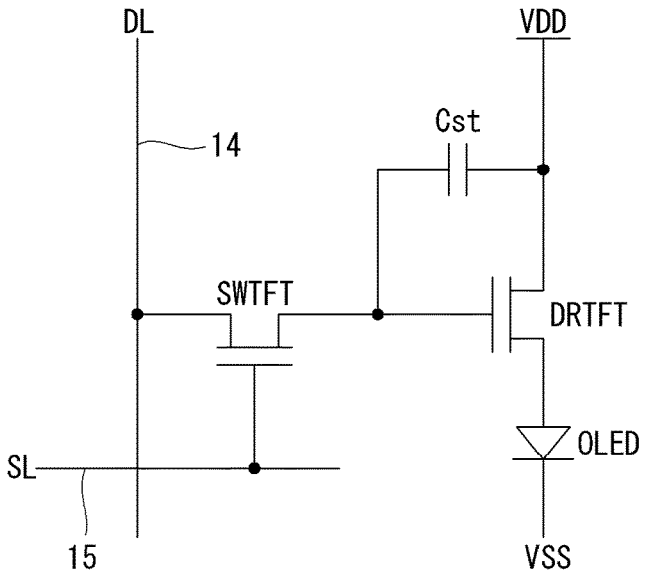
FIG. 3 is an equivalent circuit diagram of a pixel shown in FIG. 2.

As shown in FIGS. 2 and 3, an organic light emitting display according to an exemplary embodiment of the invention includes a display panel 10, a display panel driving circuit, a timing controller 11, a host system 100, etc.

Figure 1:
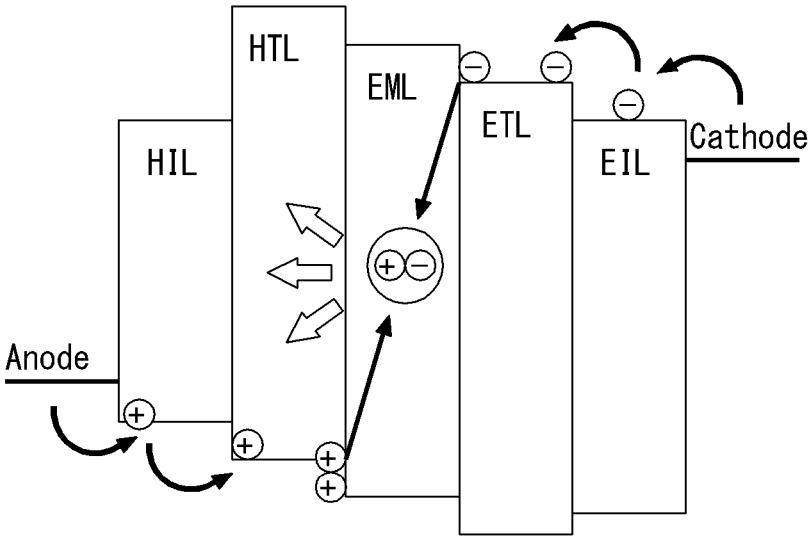
FIG. 1 (RELATED ART)
FIG. 1 shows a structure and an emission principle of an organic light emitting diode (OLED)

The display panel 10 includes a plurality of data lines 14 and a plurality of gate lines 15 crossing the data lines 14. A pixel array of the display panel 10 includes pixels P which are disposed in a matrix form and display an input image. As shown in FIG. 3, each pixel P includes an organic light emitting diode (OLED), a switching element SWTFT, a driving element DRTFT, a storage capacitor Cst, etc. The switching element SWTFT and the driving element DRTFT may be implemented as a thin film transistor (TFT). As shown in FIG. 1, the OLED may include organic compound layers, such as a hole injection layer HIL, a hole transport layer HTL, an emission layer EML, an electron transport layer ETL, and an electron injection layer EIL, which are stacked between an anode and a cathode. The switching element SWTFT applies a data voltage input through the data line 14 to a gate of the driving element DRTFT in response to a gate pulse. A gate of the switching element SWTFT is connected to the gate line 15. A drain of the switching element SWTFT is connected to the data line 14, and a source of the switching element SWTFT is connected to the gate of the driving element DRTFT. The driving element DRTFT adjusts a current flowing in the OLED depending on a gate voltage. A high potential power voltage VDD for driving the pixel is applied to a drain of the driving element DRTFT. A source of the driving element DRTFT is connected to the anode of the OLED. The storage capacitor Cst is connected between the gate and the drain of the driving element DRTFT. The anode of the OLED is connected to the source of the driving element DRTFT, and the cathode of the OLED is connected to a ground level voltage source GND. Each pixel P may additionally include an internal compensation circuit (not shown). The internal compensation circuit compensates for changes in a threshold voltage and a mobility of the driving element DRTFT The display panel driving circuit includes a data driving circuit 12 and a gate driving circuit 13. The display panel driving circuit writes data of the input image modulated by the timing controller 11 on the display panel 10 and reproduces the input image on the display panel 10.

The data driving circuit 12 includes at least one source driver integrated circuit (IC). The data driving circuit 12 converts pixel data DATA of the input image received from the timing controller 11 into analog gamma compensation voltage and generates the data voltage. The data driving circuit 12 outputs the data voltage to the data lines 14. The pixel data DATA input to the data driving circuit 12 is digital video data of the input image. Each pixel data DATA includes red data, green data, and blue data.

The gate driving circuit 13 supplies a gate pulse (or a scan pulse) synchronized with an output voltage of the data driving circuit 12 to the gate lines 15 under the control of the timing controller 11. The gate driving circuit 13 sequentially shifts the gate pulse and sequentially selects the pixels P, on which the data is written, on a per line basis.

The host system 100 may be implemented as one of a television system, a set-top box, a navigation system, a DVD player, a Blu-ray player, a personal computer (PC), a home theater system, and a phone system. The host system 100 calculates an average picture level (hereinafter referred to as "APL") in each frame of the input image. The host system 100 selects an APL curve type depending on a user input through a user interface (UI) 110. The host system 100 performs at least one luminance adjusting unit selected through the user interface 110 and adjusts the selected APL curve, thereby producing APL curve data APL'. The host system 100 transmits the APL curve data APL' to the timing controller 11. The APL curve data APL' may be 8-bit data.

The APL curve data APL' output from the host system 100 may be transmitted to the timing controller 11 in a vertical blank period of each frame period. The vertical blank period is a period between an Nth frame period and an (N+1)th frame period, where N is a positive integer. There is no data in the vertical blank period.

The timing controller 11 receives the pixel data DATA of the input image, the APL curve data APL', and timing signals from the host system 100. The timing controller 11 modulates gray levels of the pixel data DATA, so that a luminance of the input image is limited to a luminance equal to or less than a maximum luminance defined in the APL curve data APL'. Further, the timing controller 11 generates timing control signals DDC and GDC for controlling operation timings of the data driving circuit 12 and the gate driving circuit 13 based on the timing signals received along with the pixel data DATA of the input image. The timing signals input to the timing controller 11 include a vertical sync signal Vsync, a horizontal sync signal Hsync, a data enable signal DE, and a main clock CLK, etc.

The timing controller 11 modulates the pixel data DATA of the input image based on a luminance defined in the APL curve data APL' received from the host system 100 using a data modulator 20 and transmits the modulated pixel data DATA to the data driving circuit 12. The data modulator 20 may be implemented as a lookup table LUT. The data modulator 20 modulates the pixel data DATA of the input image and may adjust a luminance or a color temperature of a display image displayed on the display panel 10. The lookup table LUT receives the APL curve data APL' and the pixel data DATA of the input image and outputs a modulation value previously stored in an address which the input data indicates, thereby modulating the gray levels of the pixel data DATA. The modulation value of the lookup table LUT is individually set based on each APL curve data APL' and also is individually set based on each gray level of the pixel data DATA. Hence, the luminance of the pixel data DATA is set to be equal to or less than the maximum luminance defined in the APL curve data APL'.

The user interface 110 may be implemented as a keypad, a keyboard, a mouse, an on-screen display (OSD), a remote controller having an infrared communication function or a radio frequency (RF) communication function, a touch UI, a voice recognition UI, a 3D UI, etc.

The host system 100 may be connected to a sensing unit 120. The sensing unit 120 includes an image sensor (or a camera), an illuminance sensor, a color temperature sensor, a microphone, an acceleration sensor, a gravity sensor, a proximity sensor, a terrestrial magnetism sensor, a gyroscope angular velocity sensor, etc. The sensing unit 120 converts the outputs of these sensors into digital data and supplies the digital data to the host system 100. The host system 100 may control the luminances of the pixels in response to the outputs of the sensors.

Figure 4:
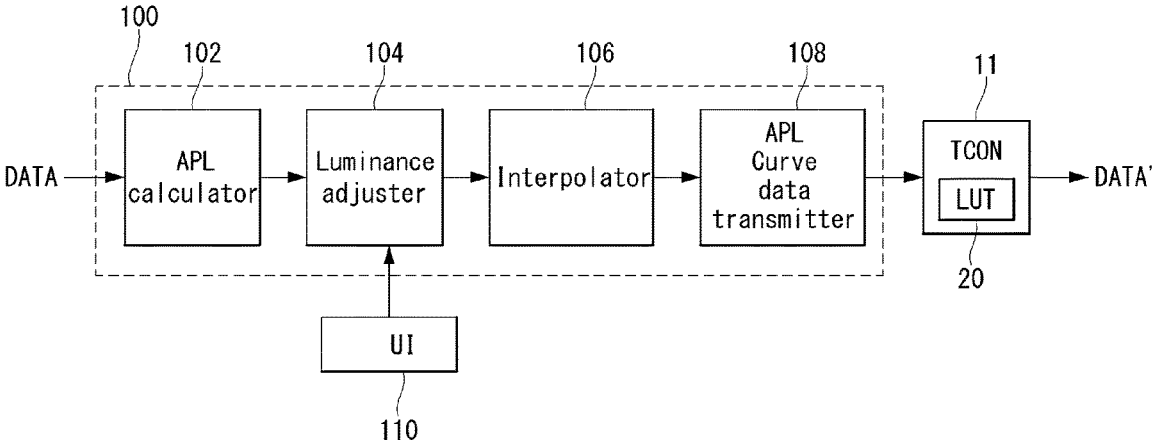
FIG. 4 is a block diagram of a graphic controller of a host system.
Figure 5:
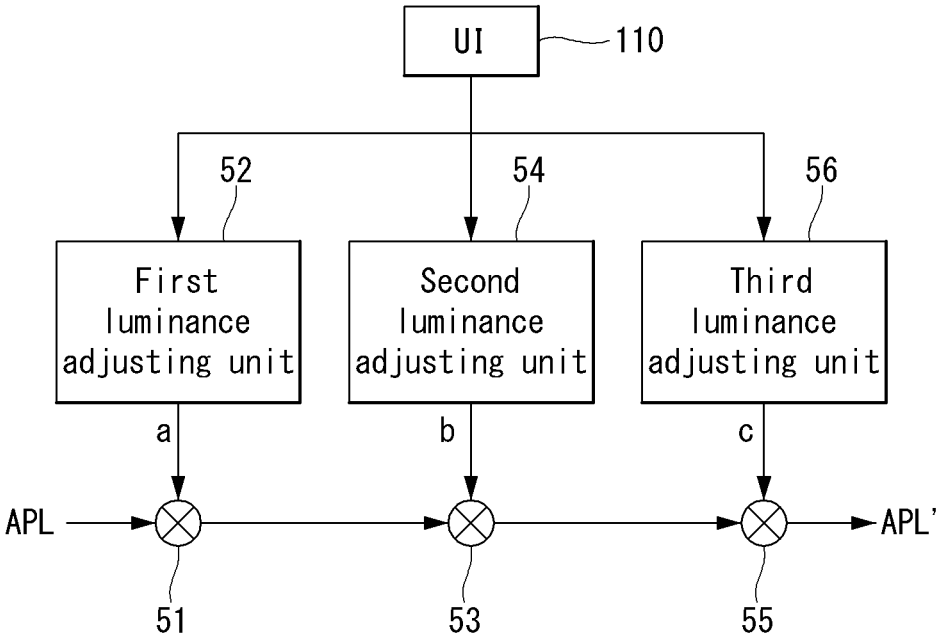
FIG. 5 is a block diagram showing in detail a luminance adjuster shown in FIG. 4.
Figure 6:
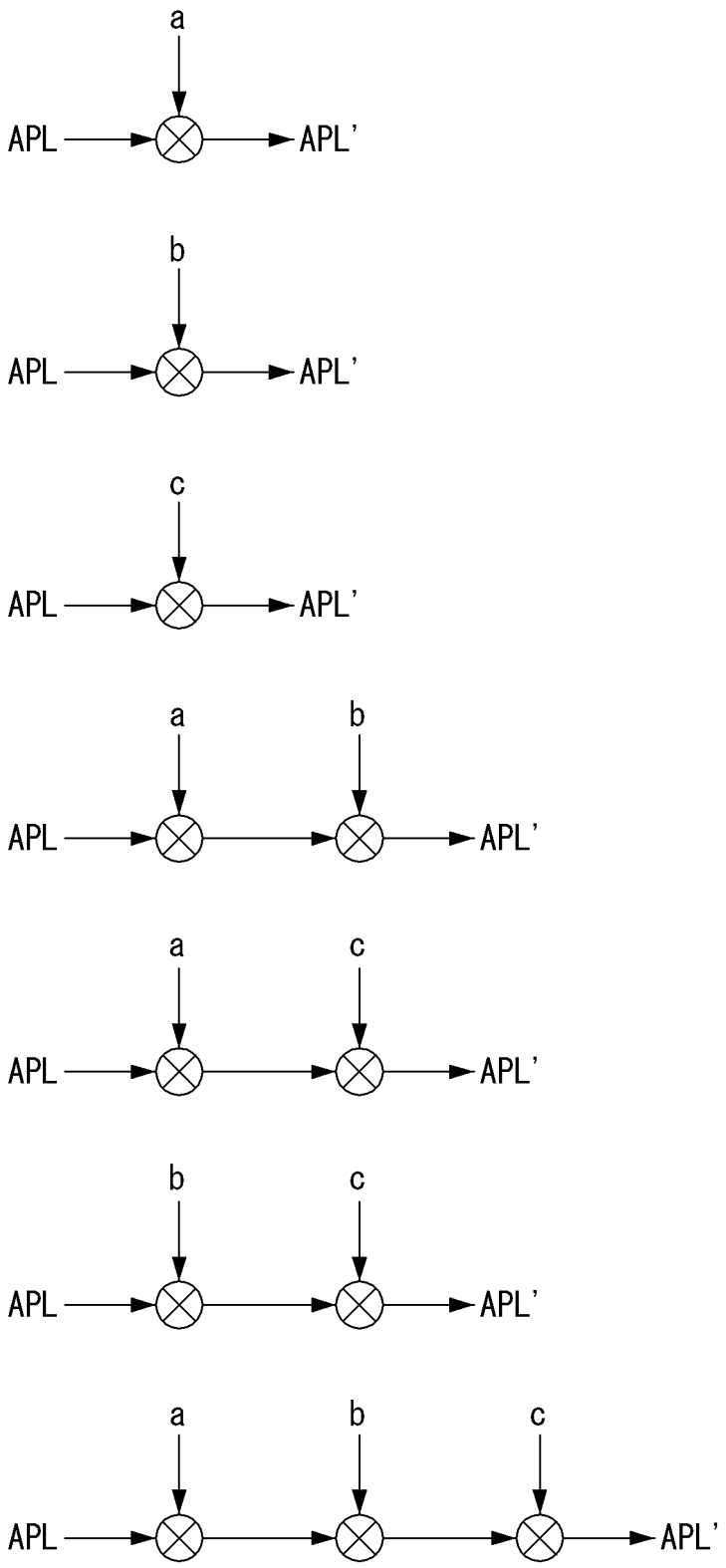
FIG. 6 shows various examples of a method for adjusting a luminance.

FIG. 4 is a block diagram of a graphic controller of the host system 100. FIG. 5 is a block diagram showing in detail a luminance adjuster shown in FIG. 4. FIG. 6 shows various examples of a method for adjusting a luminance.

As shown in FIGS. 4 to 6, a graphic controller of the host system 100 includes an APL calculator 102, a luminance adjuster 104, an interpolator 106, an APL curve data transmitter 108, etc.

The APL calculator 102 calculates the APL in each frame of the input image. The APL is an average luminance value of pixel data corresponding to one frame. In general, the high APL indicates a bright image, and the low APL indicates a dark image. The APL calculator 102 receives the APL curve data APL' from the timing controller 11 and supplies the APL curve data and the APL of the input image to the luminance adjuster 104. There may be a deviation in luminance, current, and driving characteristics of the display panel 10. The characteristic information of the display panel 10 is embedded in the timing controller 11. The APL curve data considering the characteristic deviation of the display panel 10 may be stored in the timing controller 11.

Alternatively, the APL calculator 102 may not receive the APL curve data from the timing controller 11 and may transmit the APL curve data previously stored in a built-in memory to the luminance adjuster 104.

Figure 7:
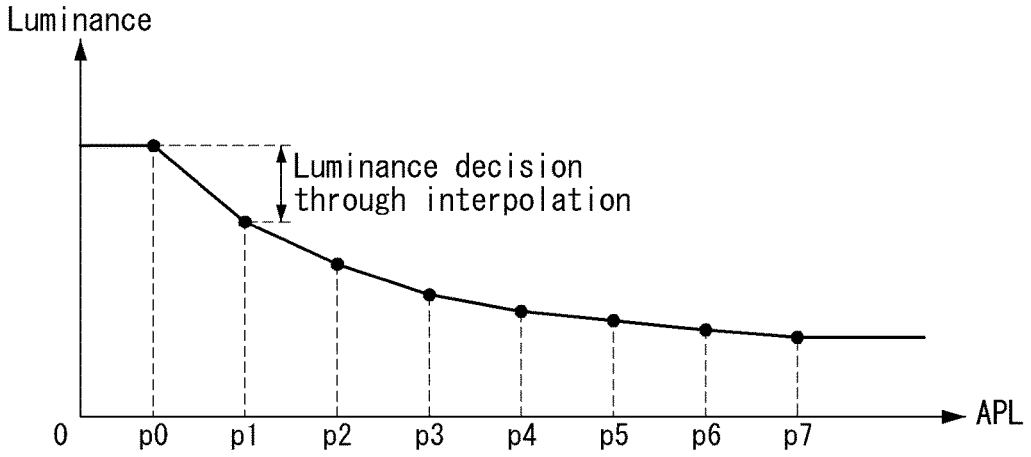
FIG. 7 shows average picture level (APL) points, which are positioned at regular intervals on an APL curve.

The APL curve data transmitted to the luminance adjuster 104 may include only N APL points p0 to p7 on the APL curve shown in FIG. 7, so as to reduce an operation amount of data, where N is a positive integer between 2 and 20. The N APL points p0 to p7 are points positioned at boundaries between neighboring sections when the APL curve is equally divided into N sections. In the APL curve shown in FIGS. 7 and 8, N is 8, for example.

The luminance adjuster 104 may select a WAPL curve based on user input data input through the user interface 110. The luminance adjuster 104 performs at least one luminance adjusting unit selected based on the user input data input through the user interface 110 and adjusts the APL curve. According to the APL curve shown in FIGS. 7 and 8, the maximum luminance of the display image increases when the APL is reduced, and the maximum luminance of the display image is reduced when the APL increases. The timing controller 11 reduces the luminance of the display device based on the APL curve and may reduce the current flowing in the OLED of the pixel.

Figure 8:
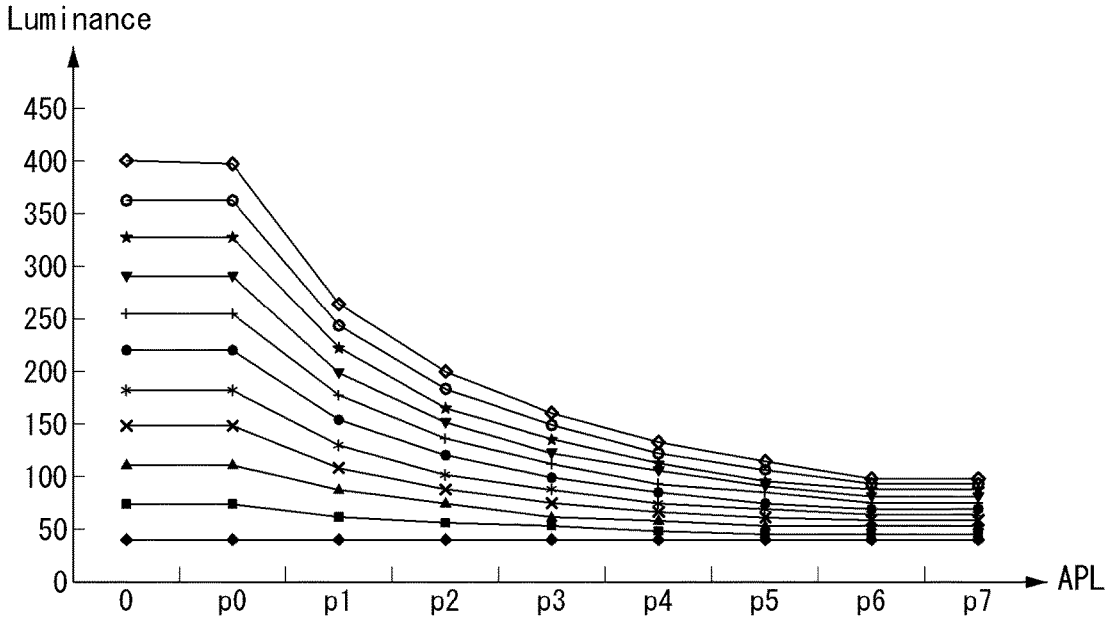
FIG. 8 shows an APL curve adjusted by a luminance adjuster shown in FIGS. 4 and 5.

The luminance adjuster 104 adjusts the APL curve data received from the APL calculator 102 and outputs the APL curve data APL' shown in FIG. 8. The APL curve defines the maximum luminance depending on the APL of the input image. According to the APL curve, when the APL of the input image is reduced, the maximum luminance of the display image increases. Further, when the APL of the input image increases, the maximum luminance of the display image is reduced. The host system 100 adjusts the APL curve using the luminance adjuster 104, thereby minimizing a reduction in the image quality. Further, the host system 100 may control power consumption at a level equal to or less than a predetermined level even if an average luminance of the input image changes.

The interpolator 106 calculates a luminance between luminances corresponding to the neighboring APL points p0 to p7 through a linear interpolation method. As a result, the interpolator 106 produces luminance data connecting the luminances corresponding to the neighboring APL points p0 to p7 and outputs the APL curve data APL' defining the maximum luminance of the display image on the entire APL curve. The APL curve data transmitter 108 transmits the APL curve data APL' received from the interpolator 106 to the timing controller 11. The data modulator 20 of the timing controller 11 modulates the pixel data of the input image based on the maximum luminance defined in the APL curve data APL' and thus may adjust the luminance or the color temperature of the display image. The data modulator 20 may be implemented as the lookup table LUT.

The luminance adjuster 104 may output the APL curve data defining the maximum luminance with respect to all of the APLs. In this instance, the interpolator 106 may be omitted, and the APL curve data output from the luminance adjuster 104 may be transmitted to the timing controller 11.

As shown in FIG. 5, the luminance adjuster 104 includes first to third luminance adjusting units 52, 54, and 56 and first to third multipliers 51, 53, and 55.

The first to third luminance adjusting units 52, 54, and 56 may be enabled to operate or disabled depending on the input of the user interface 110. The input of the user interface 110 may be an input of a set maker manufacturing the display device or an input of a user using the display device.

Figure 10:
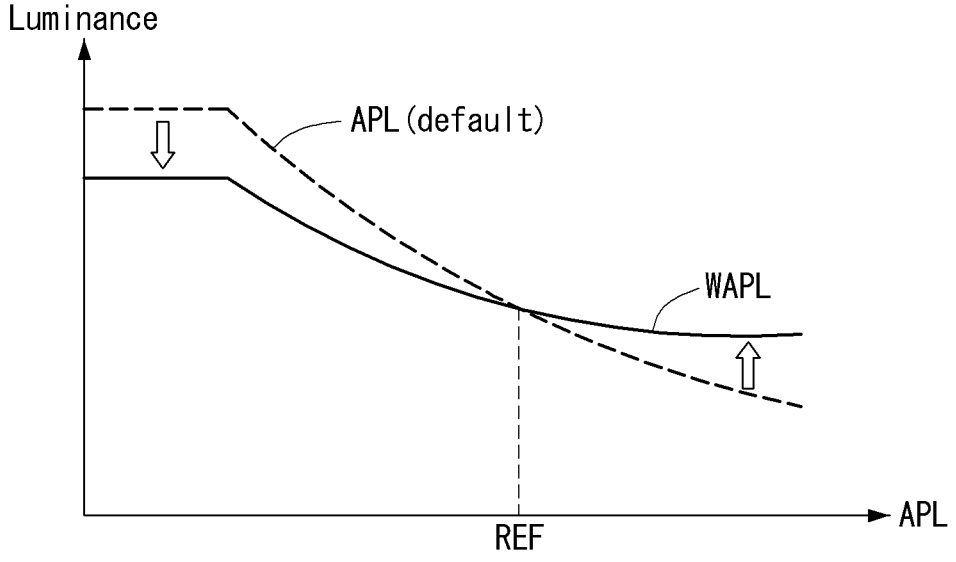
FIG. 10 shows a default APL curve and a WAPL curve.

The first luminance adjusting unit 52 selectively changes the input APL curve data to WAPL curve data based on the input of the user interface 110. The input of the user interface 110 may be an input of the set maker or the user. The first luminance adjusting unit 52 may adjust the luminance of the input APL curve by multiplying a luminance of each of the input APL points p0 to p7 by a first weight value 'a' and may generate the WAPL curve data. As shown in FIG. 10, a WAPL curve is an APL curve optimized so that the luminance and the power consumption are reduced at the low APL. The first weight value 'a' may be set to a value, which is greater than zero and less than 1, at an APL equal to or less than a APL 'REF' shown in FIG. 10. The first weight value 'a' may be set to a value between 1 and 2 at an APL greater than the APL 'REF'. The APL 'REF' is a first reference APL for dividing the low APL and the high APL and is not limited to a specific APL. The APL 'REF' may be variously determined based on an experimental result and the characteristics of the display panel 10. The first multiplier 51 adjusts the luminances of the APL points p0 to p7 by multiplying the luminance of each of the APL points p0 to p7 by the first weight value 'a'.

Figure 11:
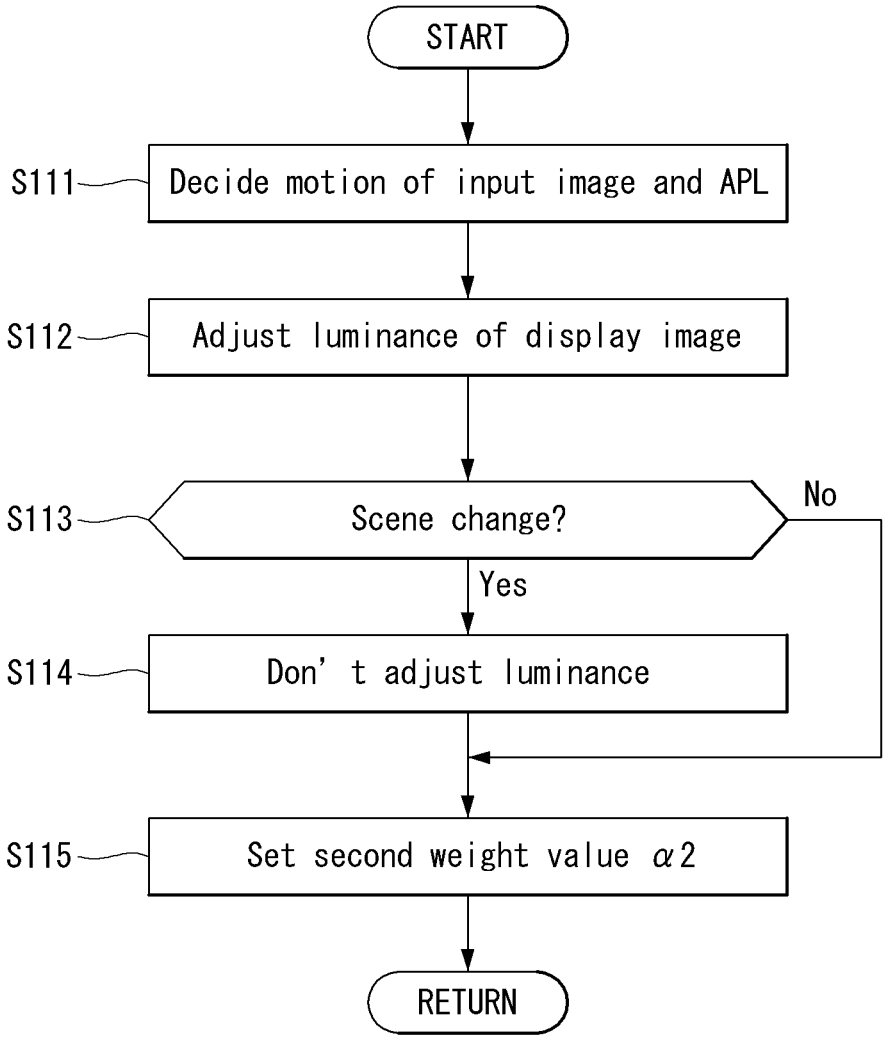
FIG. 11 is a flow chart showing an operation of a second luminance adjusting unit shown in FIG. 5.

As shown in FIG. 11, the second luminance adjusting unit 54 decides a motion of the input image and the input APL and adjusts the luminance of the display image, thereby reducing the power consumption and preventing the user from glaring. The second luminance adjusting unit 54 may adjust the luminance of the APL curve using a second weight value 'b'. The second weight value 'b' is set to be greater than zero and equal to or less than 1. The second multiplier 53 adjusts the luminances of the APL points p0 to p7 by multiplying the luminance of each of the APL points p0 to p7 by the second weight value 'b'.

Figure 14:
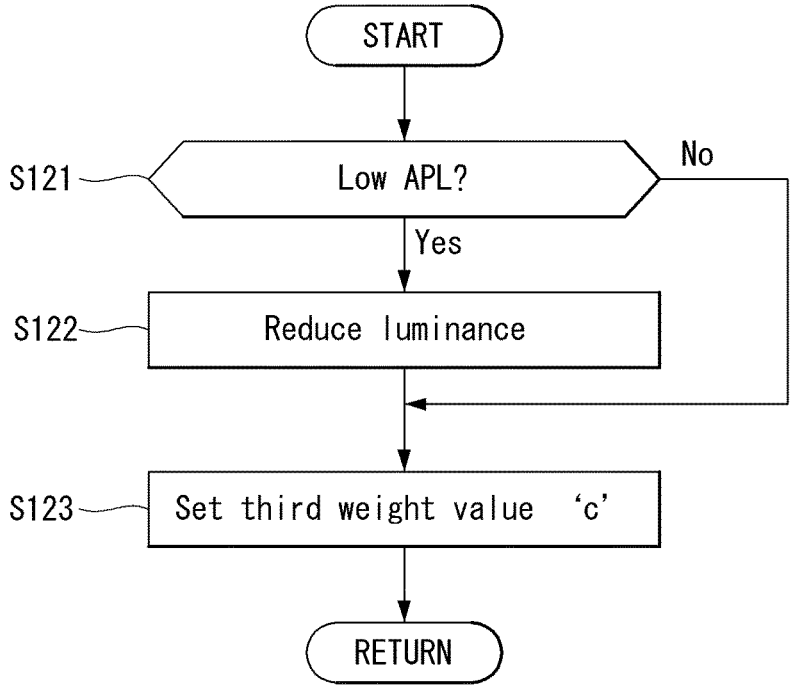
FIG. 14 is a flow chart showing an operation of a third luminance adjusting unit shown in FIG. 5.

When the input image is a moving image, the third luminance adjusting unit 56 reduces the luminance of the input image at the low APL as shown in FIG. 14, thereby obtaining a reduction effect of the power consumption. The third luminance adjusting unit 56 may adjust the luminance of the APL curve using a third weight value 'c'. The third weight value 'c' is set to be greater than zero and equal to or less than 1. The third multiplier 55 adjusts the luminances of the APL points p0 to p7 by multiplying the luminance of each of the APL points p0 to p7 by the third weight value 'c'.

The set maker or the user may select the first to third luminance adjusting units 52, 54, and 56 through the user interface 110. The luminance adjuster 104 sequentially adjusts the luminances of the APL points using at least one weight value output from the luminance adjusting unit the user selects. For example, as shown in FIG. 6, the luminance adjuster 104 multiplies the luminance of each of the APL points p0 to p7 by at least one of the first to third weight values a, b, and c so as to adjust the luminance of the display image, thereby adjusting the luminances corresponding to the APL points.

Figure 9:
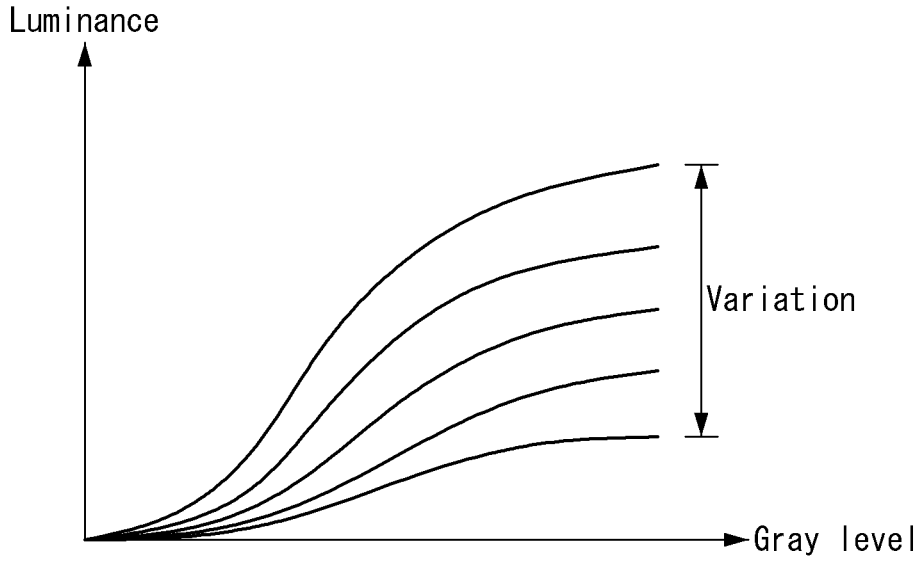
FIG. 9 is a graph showing a luminance of a display image adjusted based on an APL curve.

FIG. 7 shows the APL points p0 to p7, which are positioned at regular intervals on the APL curve. FIG. 8 shows the APL curve adjusted by the luminance adjuster 104 shown in FIGS. 4 and 5. FIG. 9 is a graph showing a luminance of the display image adjusted based on the APL curve.

As shown in FIG. 7, when the APL curve is equally divided into the N sections, the APL curve date input to the luminance adjuster 104 may include only the N APL points p0 to p7 positioned at the boundaries between the neighboring sections. The luminance adjuster 104 adjusts the luminance of the APL at each of the N APL points p0 to p7 using the weight values a, b, and c, thereby reducing the luminance and the power consumption of the display image while minimizing a reduction in the image quality of the display image the user perceives. On the APL curve, the maximum luminance of the display image having a value equal to or less than the APL at the first APL point p0 is fixed to a maximum value. As the APL gradually increases to a value greater than the APL at the first APL point p0, the maximum luminance of the display image gradually is reduced. Further, the maximum luminance of the display image having a value greater than the APL at the eighth APL point p7 is fixed to a minimum value.

The luminance adjuster 104 multiply the luminance of the APL curve data by the weight value to adjust the APL curve data APL' as shown in FIG. 8. The luminance adjuster 104 transmits the APL curve data APL' to the timing controller 11 through a serial communication interface, for example, $I^2C$ communication. The timing controller 11 may transmit the luminance data of the APL points p0 to p7, which are previously determined through a test process so that the APL points p0 to p7 are optimized for the display panel, to the APL calculator 102 through the serial communication interface. The timing controller 11 modulates the gray level of the pixel data using the maximum luminance of the display image defined in the APL curve data APL'. The luminance of the display image changes depending on the gray level of the pixel data along 2.2 gamma curve as shown in FIG. 9. The maximum luminance of the display image is equal to a maximum luminance defined in the APL curve data APL'.

FIG. 10 shows a default APL curve and a WAPL curve.

As shown in FIG. 10, the APL curve data input to the luminance adjuster 104 is the default APL curve data shown in FIGS. 7 and 8.

When the first luminance adjusting unit 52 is selected through the user interface 110, the first luminance adjusting unit 52 multiplies a luminance of the default APL curve data (indicated by the dotted line 'APL(default)') by the first weight value 'a' and generates WAPL curve data (indicated by the solid line 'WAPL').

A luminance of the WAPL curve data is set to be less than the luminance of the default APL curve data in an APL section equal to or less than the first reference APL 'REF', but is set to be greater than the luminance of the default APL curve data in an APL section greater than the first reference APL 'REF'. The first reference APL 'REF' is not limited to a specific value and may be optimized depending on the characteristics of the display panel through an experiment. The first weight value 'a' may be set to be greater than zero and less than 1 in the APL section equal to or less than the first reference APL 'REF', but may be set to be greater than 1 and less than 1.5 in the APL section greater than the first reference APL 'REF'. Other values may be used for the first weight value 'a'.

In most of moving image data, an amount of data in the low APL section is much more than an amount of data in the high APL section. This is the same as a result of the analysis of an amount of data in a standard moving image sample "IEC 62087" mostly used in an image quality evaluation. Thus, when the luminance of the display device is controlled using the WAPL curve data, the power consumption in case of using the WAPL curve data may be lower than the default APL curve data.

Because the WAPL curve data increases the luminance of the display image in the high APL section, the contrast ratio of the display image may increase. However, the WAPL curve data may distort the gamma characteristic shown in FIG. 9. Because of this, the embodiment of the invention may cause the set maker or the user to select the WAPL curve data in response to the user input data input through the user interface 110 in consideration of the power consumption and the distortion of the gamma characteristic.

A picture sound mode PSM may be set in the host system 100. The first luminance adjusting unit 52 may adjust the maximum luminance of the display image based on the picture sound mode PSM.

The picture sound mode PSM defines various image modes, which the user can select, in consideration of a viewing environment and viewing condition of the user using the display device. For example, the picture sound mode PSM may include a vivid mode, a standard mode, an eco mode, a cinema mode, a game mode, an expert mode, etc. which the user can select through the user interface 110. The user may select the image modes defined in the picture sound mode PSM through the user interface 110. The first luminance adjusting unit 52 may select the WAPL curve in the eco mode and may select the default APL curve in the cinema mode. The various image modes are described below.

The vivid mode is an image mode, in which the image quality is improved to the maximum so as to show a bright and vivid image in a store. The standard mode is a standard image mode, in which the user can comfortably use at the home. The eco mode is an image mode for optimizing a shipment mode and the power consumption. The cinema mode is an image mode optimized to watch a movie in darkroom condition. The game mode is an image mode (delay time optimization) optimized to play a game. The expert mode is an image mode for image quality experts.

In all of the image modes, a luminance of a black gray is the same, but a luminance of the maximum gray level (or peak white gray level) is differently set depending on the viewing environment and the viewing conditions of the user. Thus, the image modes defined in the picture sound mode PSM may differently set the maximum luminance and a contrast ratio of the display image. The vivid mode is the image mode capable of controlling the display image to the maximum brightness. Because the cinema mode and the expert mode are optimized image modes in a darkroom environment, the maximum luminance of the display image may be set to be dark.

A method for selecting the image mode in the picture sound mode PSM may be directly selected by the user. In the image mode which receives a sensor signal and decides the viewing environment, image quality setting values may be automatically set based on the surrounding environment. For example, when a peripheral illuminance of the display device is bright, the luminance and the contrast ratio of the display image may be automatically set to the maximum. On the other hand, when the peripheral illuminance of the display device is dark, the luminance of the display image may be reduced and may be automatically set, so that a sharpness value is reduced.

Figures 12, 13:
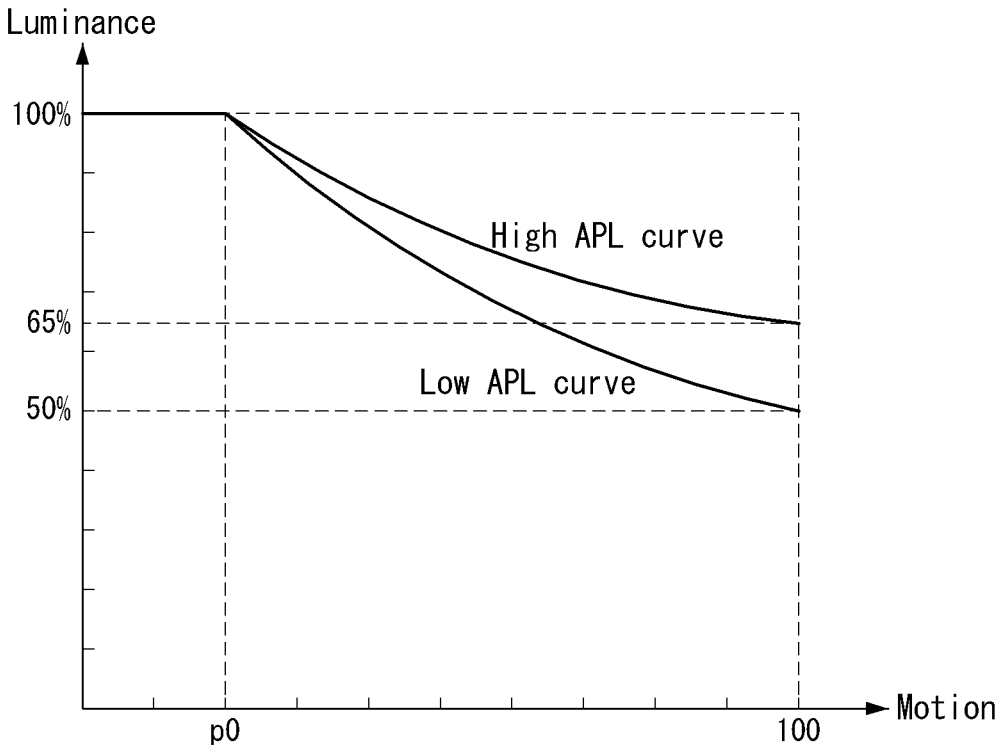
FIG. 12 shows a method for adjusting a maximum luminance of a display image depending on a motion and an APL of an input image.
FIG. 13 shows a luminance defined by each image mode included in a picture sound mode in a second luminance adjusting unit.

FIGS. 11 to 13 show an operation of the second luminance adjusting unit 54.

As shown in FIGS. 11 to 13, the second luminance adjusting unit 54 decides a motion of the input image and the input APL curve data and adjusts the luminance of the display image using the second weight value 'b' in steps S111, S112, and S115. The second luminance adjusting unit 54 analyzes the input image using a known motion estimation/motion compensation (MEMC) algorithm and may decide the motion of the input image using a calculated motion vector. Further, the second luminance adjusting unit 54 may decide the motion of the input image using the motion vector received along with the input image. As shown in FIG. 12, the second luminance adjusting unit 54 reduces the maximum luminance of the display image using the second weight value 'b' as the motion of the input image increases. In this instance, as the APL curve data is reduced, the maximum luminance of the display image is reduced. Hence, the maximum luminance of the display image at the low APL curve data is less than that at the high APL curve data. For example, as shown in FIG. 12, when the motion of the input image is 100, the second luminance adjusting unit 54 controls the maximum luminance of the display image at the low APL curve to 50% and controls the maximum luminance of the display image at the high low APL curve to 65%. The second luminance adjusting unit 54 may not adjust the maximum luminance of the display image in the low APL section where the input APL is equal to or less than the first APL point p0.

The second luminance adjusting unit 54 may differently control the motion of the input image and the APL in each image mode included in the picture sound mode PSM. For example, the second luminance adjusting unit 54 controls the luminance of the display image based on the low APL curve shown in FIG. 12 in the standard mode and does not adjust the luminance of the display image in the vivid mode, the cinema mode, and the game mode.

When the scene changes, the second luminance adjusting unit 54 does not adjust the luminance of the display image and maintains it in steps S113 and S114. This is because if the luminance of the display image is adjusted depending on the motion of the input image in the change of the scene, changes in the luminance of the display image may be greatly seen. The second luminance adjusting unit 54 calculates a histogram of the input image. Hence, when the histogram sharply changes, the second luminance adjusting unit 54 may decide the sharp change of the histogram as timing of the scene change. The second luminance adjusting unit 54 sets the second weight value 'b' to 1 when the scene changes, and does not adjust the luminance of the display image in step S115.

Figure 15:
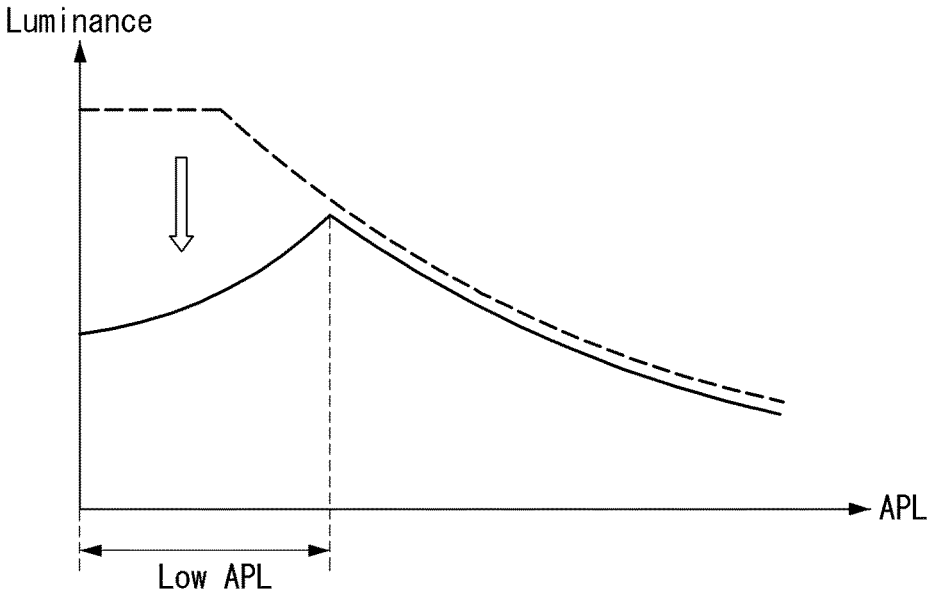
FIG. 15 shows an example of reducing a luminance of a display image at a low APL by a third luminance adjusting unit.

FIG. 14 is a flow chart showing an operation of the third luminance adjusting unit 56 shown in FIG. 5. FIG. 15 shows an example of reducing the luminance of the display image at the low APL by the third luminance adjusting unit 56.

As shown in FIGS. 14 and 15, the third luminance adjusting unit 56 reduces the luminance of the display image in the low APL section of the input APL curve data using the third weight value 'c', thereby increasing a reduction effect of the power consumption. The low APL section is an APL section equal to or less than a predetermined second reference APL. The second reference APL may be experimentally determined and may be set to the same value as or a different value from the first reference APL.

The third luminance adjusting unit 56 decides whether or not the input image is the moving image, and may adjust the APL curve data only when the moving image is input. When the moving image is input, the third luminance adjusting unit 56 sets the third weight value 'c' to a value less than 1 in the low APL section, thereby reducing the luminance of the display image. On the other hand, when a stop image is input, the third luminance adjusting unit 56 sets the third weight value 'c' to '1' in the low APL section, thereby maintaining the luminance of the input APL curve.

As the result of the analysis of the amount of data in the standard moving image sample "IEC 62087", an amount of data calculated at the low APL is more than an amount of data calculated at the high APL. Thus, the power consumption may be efficiently reduced by reducing the luminance of the display image at the low APL.

The third weight value 'c' is set to be greater than zero and less than 1 in the low APL section. The third weight value 'c' be reduced as the APL becomes close to zero. Further, the third weight value 'c' may be set to a value equal to or greater than 1, so that the luminance of the display image is not reduced in the high APL section equal to or greater than the second reference APL. In FIG. 15, the solid line indicates the APL curve data which is adjusted using the third weight value 'c' output from the third luminance adjusting unit 56.

As described above, the embodiment of the invention selectively reduces the luminance of the display image displayed on the display panel in the low APL section in response to the user data input through the user interface. As a result, the embodiment of the invention can minimize the reduction in the image quality of the display device and reduce the power consumption.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

an average picture level (APL) calculator configured to calculate an APL of an input image and output the APL of the input image and an APL curve data;

a luminance adjuster including at least two luminance adjusting units that are enabled in response to a user input through a user interface;

a data modulator configured to modulate a digital data of the input image using a luminance defined in the APL curve data adjusted by the luminance adjuster;

a display panel driving circuit configured to write the digital data modulated by the data modulator on a display panel and reproduce the input image on the display panel, a host system calculating the average picture level in each frame of the input image using the average picture level calculator, selecting the APL curve data depending on the user input, performing at least one of the luminance adjusting units selected through the user interface, and adjusting a selected APL curve data using the at least one of the luminance adjusting units; and a timing controller modulating the digital data of the input image using the data modulator and transmitting the digital data modulated by data modulator to the display panel driving circuit, and generating timing control signals for controlling operation timing of the display panel driving circuit, wherein any one of the at least two luminance adjusting units decides a motion of the input image to adjust a luminance of an APL section based on the motion of the input image, wherein the APL curve data includes only N APL points on an APL curve, where N is a positive integer between 2 and 20, wherein the N APL points are points positioned at boundaries between neighboring sections when the APL curve is equally divided into N sections, wherein the host system transmits an adjusted APL curve data outputted from the luminance adjuster to the timing controller in a vertical blank period of each frame period, wherein the luminance adjuster multiplies the luminance of the APL curve data by a weight value to adjust the selected APL curve data, and then transmits the adjusted APL curve data to the timing controller.

2. The display device of claim 1, wherein the luminance adjuster multiplies the APL points by a weight value generated from the luminance adjusting unit and adjusts the APL points.

3. The display device of claim 2, further comprising an interpolator configured to produce luminance data connecting luminances corresponding to the APL points through a linear interpolation method and output the APL curve data defining a maximum luminance of a display image reproduced on the display panel on the APL curve to the data modulator.

4. The display device of claim 3, wherein the luminance adjuster includes:

a first luminance adjusting unit configured to generate a first weight value that reduces a luminance of an APL section equal to or less than a first reference APL on an input APL curve and increases a luminance of an APL section greater than the first reference APL; and a first multiplier configured to multiply luminances of the APL points of the input APL curve by the first weight value.

5. The display device of claim 4, wherein the luminance adjuster includes:

a second luminance adjusting unit configured to generate a second weight value that reduces the maximum luminance of the display image as the motion of the input image increases; and a second multiplier configured to multiply the APL points of the input APL curve or the luminances of the APL points from the first multiplier by the second weight value.

6. The display device of claim 5, wherein as the APL curve data is reduced, the second luminance adjusting unit reduces the second weight value and reduces the maximum luminance of the display image.

7. The display device of claim 6, wherein the luminance adjuster includes:

a third luminance adjusting unit configured to generate a third weight value that reduces a luminance of an APL section equal to or less than a second reference APL on the input APL curve and maintains a luminance of an APL section greater than the second reference APL; and a third multiplier configured to multiply the luminances of the APL points of the input APL curve by the third weight value.

8. The display device of claim 1, wherein the timing controller transmits a luminance data of the APL points to the average picture level calculator, and modulates a gray level of the digital data based on the adjusted APL curve data.

9. The display device of claim 1, wherein the host system receives the APL curve data from the timing controller and supplies the adjusted APL curve data to the timing controller.

10. The display device of claim 1, wherein the display panel driving circuit includes:

a data driving circuit to convert the digital data modulated by the data modulator received from the timing controller into analog gamma compensation voltage to generate a data voltage to be supplied to data lines of the display panel; and a gate driving circuit to supply a gate pulse synchronized with the data voltage outputted from the data driving circuit to gate lines of the display panel under a control of the timing controller.

11. A method for controlling a luminance of a display device comprising:

calculating an average picture level (APL) of an input image and outputting the APL of the input image and an APL curve data;

reducing a luminance of an APL section in the APL curve data in response to a user input through a user interface;

deciding a motion of the input image to adjust a luminance of the APL section based on the motion of the input image;

modulating a digital data of the input image based on a luminance defined by the APL curve data, in which the luminance of the APL section is adjusted; and writing the digital data modulated by the APL curve data, in which the luminance of the APL section is adjusted on a display panel, wherein the APL curve data includes only N APL points on an APL curve, where N is a positive integer between 2 and 20, wherein the N APL points are points positioned at boundaries between neighboring sections when the APL curve is equally divided into N sections, wherein the reducing of the luminance of the APL section includes multiplying the APL points by a weight value to adjust the APL points, wherein the method for controlling the luminance of the display device further comprises:

producing luminance data connecting luminances corresponding to the APL points through a linear interpolation method, generating a first weight value that reduces a luminance of an APL section equal to or less than a first reference APL on the input APL curve and increases a luminance of an APL section greater than the first reference APL; and multiplying luminances of the APL points of the input APL curve by the first weight value.

12. The method of claim 11, further comprising:

generating a second weight value that reduces a maximum luminance of the display image as the motion of the input image increases; and multiplying the APL points of the input APL curve or the luminances of the APL points by the second weight value.

13. The method of claim 12, wherein the second weight value is reduced as the APL curve data is reduced.

14. The method of claim 13, further comprising:

generating a third weight value that reduces a luminance of an APL section equal to or less than a second reference APL on the input APL curve and maintains a luminance of an APL section greater than the second reference APL; and multiplying the luminances of the APL points of the input APL curve by the third weight value.

* * * * *